US005100132A

United States Patent [19]

Anderson et al.

[11] Patent Number: 5,100,132

[45] Date of Patent: Mar. 31, 1992

[54] PORTABLE BASKETBALL GOAL ASSEMBLY

[76] Inventors: Gavin M. Anderson, 4951 Whites Bridge Rd., Belding, Mich. 48809; James C. Anderson, 2006 Wealthy St., Grand Rapids, Mich. 49506

[21] Appl. No.: 715,480

[22] Filed: Jun. 14, 1991

[51] Int. Cl.[5] ..... A63B 63/08

[52] U.S. Cl. ..... 273/1.5 R

[58] Field of Search ..... 273/1.5 R

[56] References Cited

U.S. PATENT DOCUMENTS

| | | | |
|---|---|---|---|
| 1,520,983 | 12/1924 | Taylor . | |
| 2,227,310 | 12/1940 | Hoppes et al. . | |
| 2,340,540 | 2/1944 | Lange . | |
| 3,018,102 | 1/1962 | Murphy . | |
| 3,028,136 | 4/1962 | Vento . | |
| 3,598,407 | 8/1971 | Sorensen | 273/1.5 R |
| 3,603,588 | 9/1971 | Epstein | 273/1.5 R |
| 3,881,724 | 5/1975 | Beveridge | 273/1.5 R |
| 4,330,101 | 5/1982 | Andersen | 273/1.5 R X |
| 4,412,679 | 11/1983 | Mahoney et al. | 273/1.5 R |
| 4,546,973 | 10/1985 | Mouser | 273/1.5 R |
| 4,726,556 | 2/1988 | Weir | 248/454 |
| 4,946,163 | 8/1990 | Aarke et al. | 273/1.5 R |

OTHER PUBLICATIONS

The Sporting Goods Dealer 6-1976 p. 131.

*Primary Examiner*—Paul E. Shapiro

*Attorney, Agent, or Firm*—Waters & Morse

[57] ABSTRACT

A portable basketball goal assembly comprises a pair of collapsible backboard support mechanisms mounted in back-to-back relationship on opposite ends of a base. The support mechanisms fold inwardly on the base when collapsed and are offset so they overlap and lay side-by-side, thus providing a compact collapsed structure that can easily be transported on a struck. A brace mechanism connects and reinforces the support mechanisms when erected. Stacking support columns permit collapsed goal assemblies to be stacked together for shipping.

9 Claims, 6 Drawing Sheets

PORTABLE BASKETBALL GOAL ASSEMBLY

BACKGROUND OF THE INVENTION

This invention relates to a portable basketball goal assembly that supports two basketball backboards back-to-back and can be collapsed into a compact configuration that can be transported easily on a conventional flatbed truck and stacked one on top of the other.

Amateur basketball tournaments are an increasingly popular phenomenon in the United States. Such tournaments typically are three-on-three basketball tournaments conducted in an outdoor location on the streets or in a parking lot of the town or city in which the tournament is conducted. Popular tournaments may draw hundreds of teams and thousands of spectators. A tournament of this nature requires portable basketball goal assemblies, wherein the basketball goals can be transported to the location by truck, set up easily, and disassembled and moved to a new location just as easily.

An object of the present invention is to provide a collapsible and portable basketball goal assembly, wherein two basketball backboards support mechanisms are mounted back-to-back on a compact base and are collapsible and stackable on a conventional flatbed truck for easy transportation from location to location.

SUMMARY OF THE INVENTION

In accordance with the present invention, a collapsible and portable basketball goal assembly comprises a pair of collapsible backboard support mechanisms mounted at opposite ends of a portable base, with the support mechanism supporting a pair of basketball backboards in back-to-back fashion. The support mechanism collapses compactly onto the base for transport when collapsed. The support mechanisms are separated by a distance less than the height of the baskets. The support mechanisms are foldable and collapsible inwardly over the base and are offset so the support mechanisms fold inwardly in an overlapping fashion such that the support mechanisms are positioned entirely over the base. The base desirably does not exceed eight feet in length, so that the assembly can be transported on a conventional flatbed truck.

A brace mechanism is connected between the support mechanisms to provide reinforcement.

Preferably, the collapsible support mechanisms incorporate stacking support members that permit the goal assemblies to be stacked one on top of the other for transportation purposes.

The apparatus of the present invention provides a structurally rigid support mechanism for the basketball basket and backboard but is easily collapsible into a compact unit for convenient transportation and storage. Various structural features of the assembly, described in more detail below, contribute to the functional advantages of the present invention.

DETAILED DESCRIPTION OF THE PREFERRED EMBODIMENT

Figure 1:
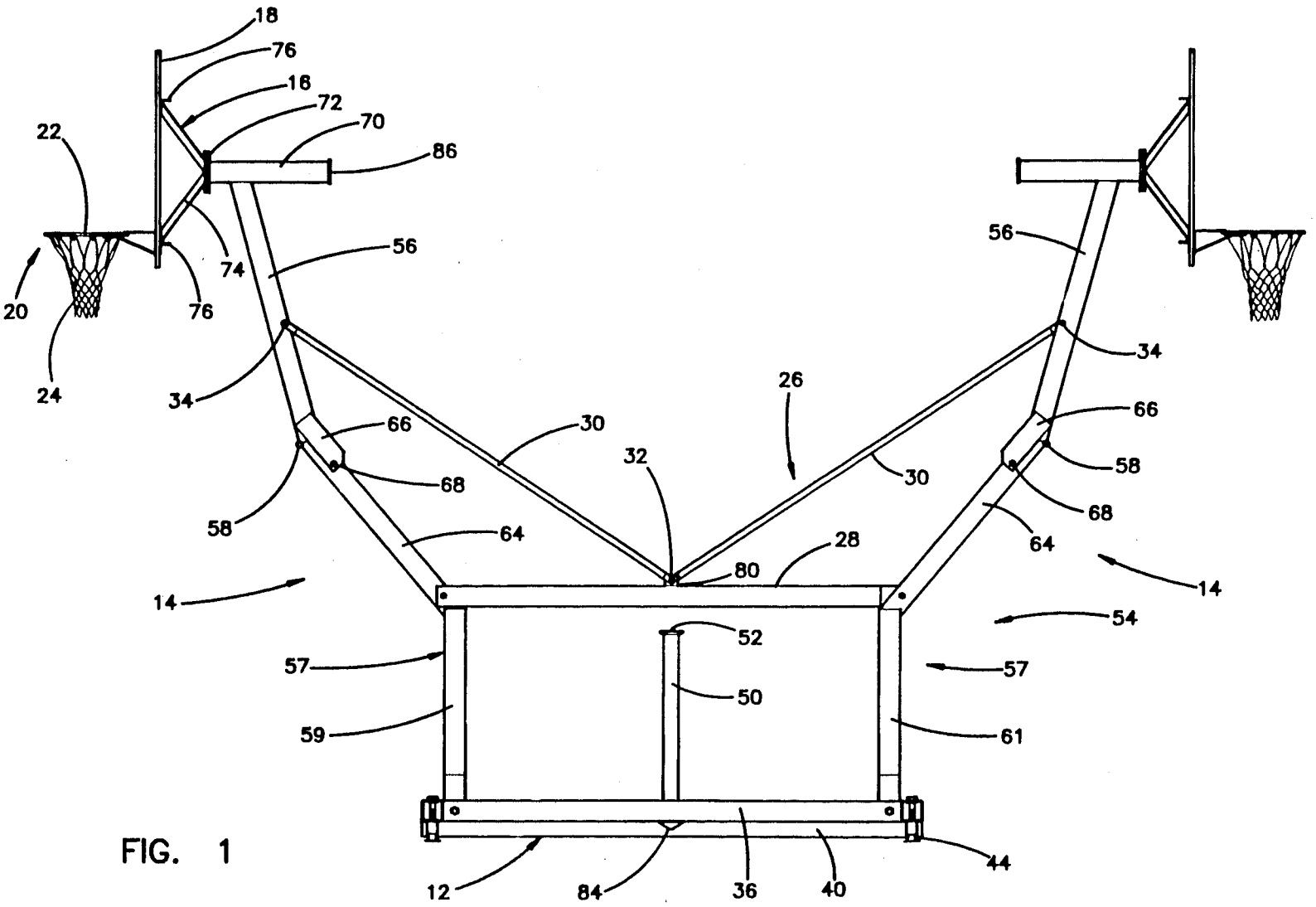
FIG. 1 is a side elevational view of the basketball goal assembly of the present invention, shown in an erected position.
Figure 6:
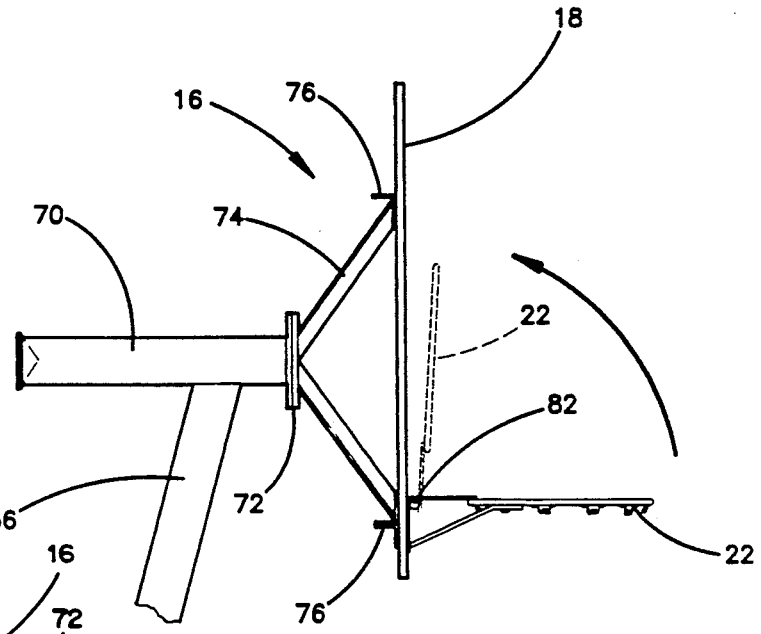
FIG. 6 is a broken view showing the support mechanism for the backboard and hoop and the pivotal hoop of the present invention.

Referring to the drawings and more particularly to FIG. 1, a portable basketball assembly 10 constructed in accordance with the present invention comprises a generally rectangular base 12 having a pair of backboard support mechanisms 14 mounted back-to-back on opposite sides of the base. A backboard mounting bracket 16 is mounted on the top of each backboard support mechanism, and a backboard 18 is fastened to the mounting bracket. A basket 20 comprising a hoop 22 and net 24 is mounted on each backboard. The backboard support mechanisms are reinforced by a brace mechanism 26 comprising a cross strut 28 that interconnects the two backboard support mechanisms and upwardly angled vertical rising struts 30 that extend from a junction 32 at the center of cross strut 28 to a fastening point 34 on an upper portion of the backboard support mechanism.

Figure 2:
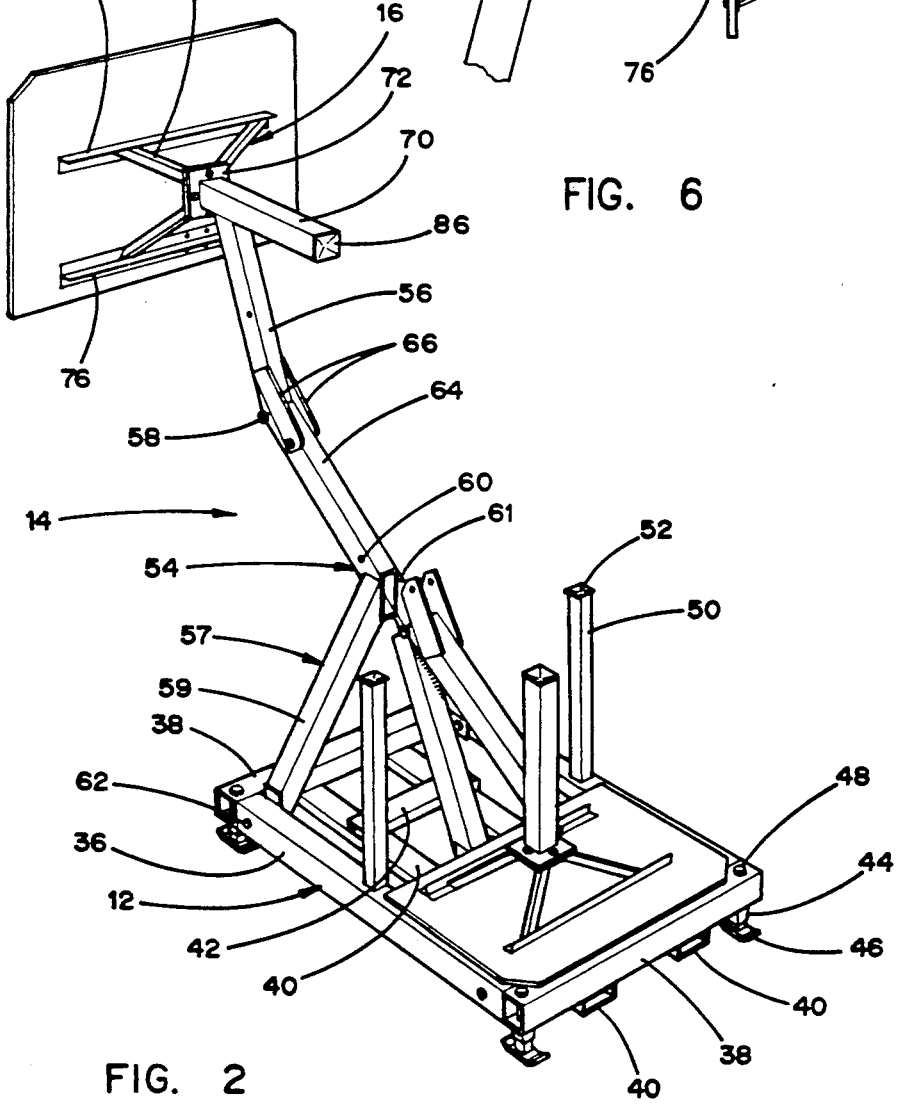
FIG. 2 is a perspective view of the goal assembly of the present invention showing one of the basketball support mechanisms erected and one of the basketball support mechanisms collapsed on the base.

Referring to FIG. 2, base 12 comprises a rectangular frame formed of rectangular tubular metal beams, with the frame having side members 36 and end members 38 on opposite sides of the frame. Desirably, the frame members are formed of tubular steel having outside dimensions of four inches by four inches and a wall thickness of 3/16ths of an inch. The frame has a pair of longitudinal reinforcing beams 40 that extend between ends 38 at positions spaced between side beams 36. Transverse reinforcing beams 42 extend between the sides 36 at positions between ends 38. Reinforcing beams 40 and 42 also are desirably formed of a tubular steel having a rectangular cross section. A base formed in this manner is sufficiently rigid and sturdy to provide the necessary support and stability to rigidly support basketball baskets.

Adjustable feet 44 extend downwardly from each corner of the base to flat ground engaging plates 46 at the lower ends. Positions of the feet are vertically adjustable by means of an adjustment screw 48. Relative rotation of the feet and the adjustment screw causes axial movement of the feet in a vertical direction in order to adjust the level of the base to suit any particular ground or floor conditions. When the baskets are used in an outdoor location, which is the typical application, it is essential to be able to adjust the level of the baskets to accommodate ground irregularities and slight elevation differences. The adjustable feet insure that the base is always positioned in a stable ground engaging position.

Stacking support columns 50 are mounted at approximately the midpoints of each side beam 36 and extend vertically upwardly therefrom to a recessed opening 52 at the upper end thereof. The stacking support columns are used for stacking one goal assembly on another when the backboard support mechanisms are collapsed.

Desirably, the base 12 is relatively small in size and dimensioned so that the base can be mounted easily on a conventional flatbed truck. Preferably, the length of the base between ends 38 is no more than about eight and one-half feet and desirably no more than about eight feet. The width of the base between sides 36 desirably is no more than about six feet and preferably about five feet. If the base is no more than about eight feet long and about five feet wide, the base can be fitted easily on the bed of a conventional flatbed truck in a sideways position (i.e., with the longer side extending transversely on the bed). If the base is longer than about eight and one-half feet, the unit cannot be carried sideways on a conventional flatbed truck without a special permit. Moreover, if the basketball backboard support mechanism hangs over the outer edge of the base, making the effective length longer than eight feet, the same transportation problems are present.

Each backboard support mechanism 14 comprises at least two separate sections pivotally connected on top of each other. Backboard support mechanism 14 comprises a lower section 54 and an upper section 56 pivotally connected together by a hinge mechanism 58 on the outer side of the support mechanism. As used herein, reference to an "outward" or "outer direction or "outer" side refers to a side facing away from the base, whereas the term "inner" shall refer to a direction facing inwardly toward the interior of the base.

Lower section 54 comprises an A-shaped bottom member 57 comprising legs 59 and 61 that extend upwardly and inwardly to an upper end 60. The lower ends of legs 58 are pivotally attached to side beams 36 by shafts or bolts 62. An upper member 64 of lower section 54 comprises an upwardly and outwardly extending beam that is attached at the upper end 60 of the A-shaped lower member. Beam 64 desirably is a rectangular steel tube having a cross section of four inches by four inches and having a wall thickness of 3/16ths of an inch.

Figure 3:
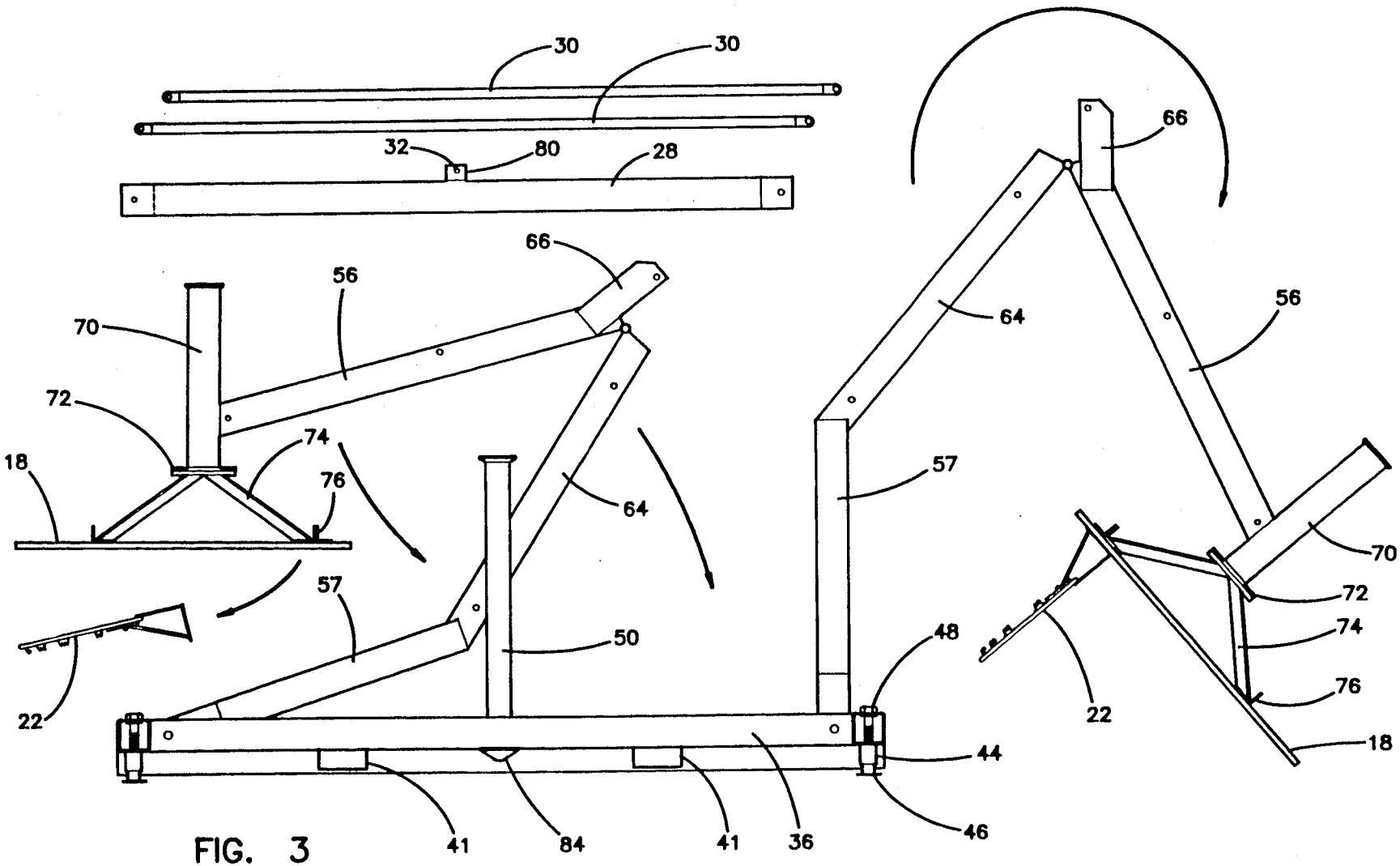
FIG. 3 is a side elevational view showing the manner in which the goal assembly is disassembled and collapsed for transportation and storage.
Figure 4:
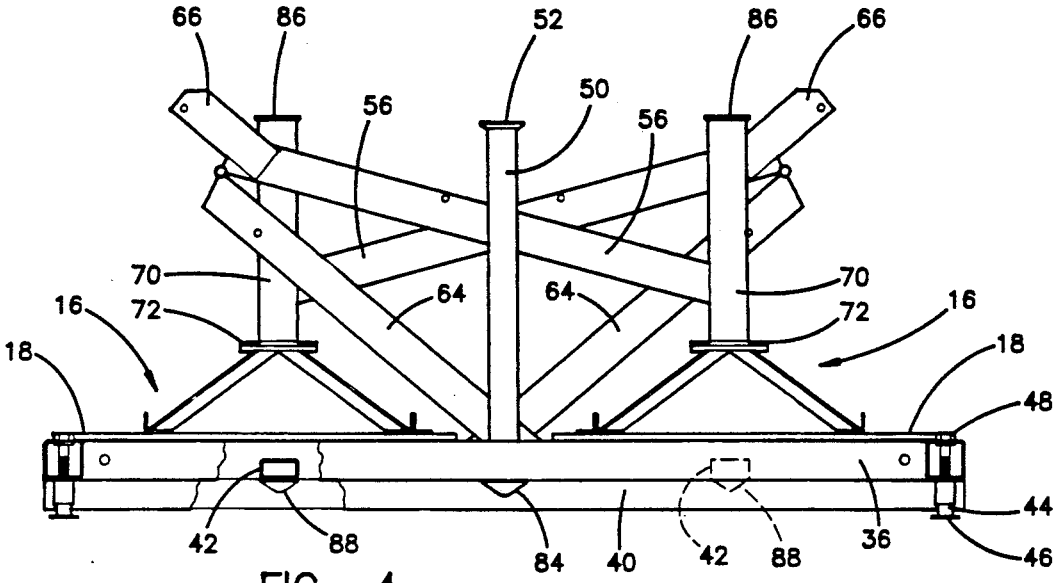
FIG. 4 is a side elevational view showing the basketball assembly in a completely collapsed position.

It is important to note that the A-shaped lower member is not symmetrically mounted on the base. Rather the legs 59 and 61 are of different lengths and are mounted so that beam 64 is offset from a centered position on the base. This is important because the lower section 54 when collapsed inwardly over the base, as shown in FIG. 3, extends more than halfway across the base, and when the backboard support mechanism on the other side is similarly folded inwardly on the base, beams 64 overlap and fit beside each other because of their offset positions. If these beams were centered on the frames, they would engage each other as the backboard assemblies are collapsed and would prevent the backboard support mechanisms from being collapsed completely on the frame.

The upper and outer end of beam 64 is connected to upper section 56, which is a similarly shaped beam, by hinge 58. Abutting ends of beams 56 and 64 are beveled to mate with each other in order to limit the extent to which beam 56 can be pivoted inwardly with respect to beam 64. This provides additional structural rigidity to the frame when erected. In addition, a pair of plates 66 are welded to upper section 56 on each side thereof and abut the outer sides of beam 64. These plates are bolted to beam 64 by bolts 68 that fit through mating openings in the plates nd beam 64. When the plates are bolted to beam 64, upper section 56 is rigidly held in an erect position relative to beam 64. As shown in FIG. 1, upper section 56 does not extend in a vertical direction but extends outwardly somewhat as well as upwardly. The outward inclination of beam 64 and upper section 56 serves to separate the backboards further from the base structure, which is desirable because it gives the players more room under the backboard to maneuver and removes the support structures further from the playing area. The beams can be made to be telescoping, if desired, to provide additional adjustment.

The upper end of beam 56 is connected to a beam 70, which is horizontal in the erected position of the backboard support mechanism. Beam 70 is in turn connected to the backboard mounting bracket 16. Backboard mounting bracket comprises a plate 72 mounted on the outer end of beam 70 and arms 74 extending from each corner of plate 72 in an outwardly inclined direction to a supporting position against the back of the backboard. Arms 74 abut horizontal angle brackets 76 on the upper and lower portions of the backboard and are fastened thereto.

The manner in which A-shaped lower member 57 is pivotally mounted to side members 36 causes the legs 59 to engage and be stopped by end members 38 when the lower section has pivoted to a vertical position. Thus, when the backboard support mechanism has been erected and the sections bolted together, the backboard will stand on its own. However, the backboard support mechanism is still subject to pivotal rotation in an inward direction about pivot shafts 62. In order to brace the individual backboard support mechanisms and provide additional rigidity for the structure when the backboard support mechanisms are erected, the two back-to-back support mechanisms are interconnected by brace mechanism 26. Cross brace 28, which is a two-by-four inch rectangular tubular beam, is bolted at each end to the lower end of beam 64 at a point just above the junction of legs 59. Because of the offset nature of these beams, cross strut 28 is bolted on one side to one beam 64 and is bolted on the other side to the opposite beam 64. Reinforcing plates are welded on the ends of the cross strut 28 at the points where the cross strut engages the beams 64. Bolts 78 mount the cross strut to the respective backboard support mechanisms.

Vertical rising struts 30 extend upwardly from junction 32 to fastening points 34 on upper sections 56 of the backboard support mechanism. The vertical rising struts provide additional reinforcement and maintain the proper position of the upper section of the foldable backboard support mechanism with respect to the base and the lower section. Vertical rising struts 30 are preferably one inch by one and one-half inches rectangular steel tubes and have mounting plates mounted in the ends of the tubes. The mounting plates have openings that mate with openings in the upper sections 56 and bolts 34 extend through the openings to lock the struts in place. The lower ends of struts 30 are similarly formed but are attached to cross strut 28 by means of a plate 80 having an aperture therein that extends upwardly from cross strut 28.

In the present invention, cross strut 28 and vertical rising struts 30 are each eight feet long, which corresponds to the length of the base. Thus, when these struts are unbolted, they will fit within the perimeter of the base for mounting purposes. An additional advantage of the strut configurations is that the vertical rising struts are enough smaller than the cross strut that they can be slid inside the cross strut for transportation and storage, thus making the unit more compact.

As shown in FIGS. 2 and 3, when the backboard support mechanism is collapsed for storage and transportation, lower section 54 is pivoted inwardly about shafts 62, and outer section 56 is pivoted downwardly to the outside of the base. The backboard thus is pivoted from a vertical to a horizontal position when collapsed, wherein it fits securely on the base, as shown in FIG. 2. To fit the backboard in this position, the basket assembly cannot remain in its protruding position on the backboard. Thus, it must either be unbolted and removed as shown in FIG. 3 or the basket assembly can be mounted on a hinge 82 so that the basket can be pivoted upwardly so as to be flush with the backboard when it is collapsed.

When the backboard support mechanism has been fully collapsed, the backboard support mechanism and the backboards will be compactly folded on the base and will occupy an area that is completely within the perimeter of the base, thus maintaining the maximum dimension of the length of the base at eight feet.

Figure 5:
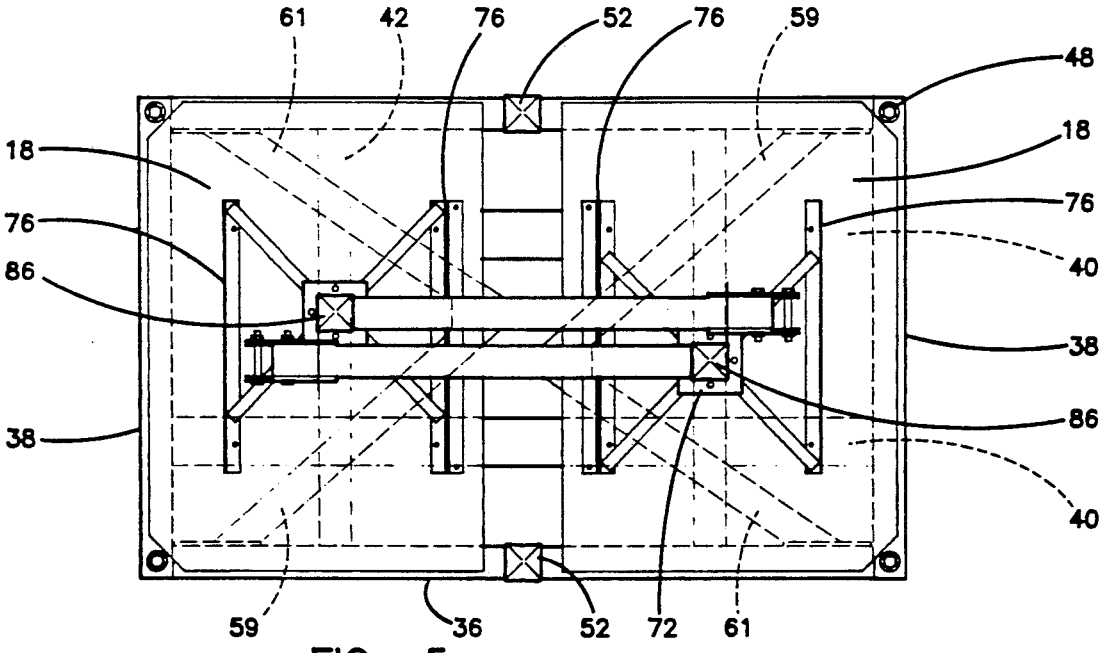
FIG. 5 is a plan view of the collapsed goal assembly shown in FIG. 4.

Another advantage of the present invention is that it incorporates stacking means for stacking goal assemblies one on top of the other for transportation and storage. As shown in FIG. 5, the recessed upper end 52 of stacking support columns 50 include pyramid-shaped recesses. These mate with correspondingly shaped projections 84 mounted on the underside of beams 36 (see FIG. 1). This nesting action insures proper placement of the goal assemblies on top of each other and also resists sideways dislodgement of the upper goal assembly from the lower goal assembly.

Beams 70 on the upper ends of the backboard support mechanisms provide additional stacking support columns, so that the goal assemblies are supported at four spaced locations on the lower goal assembly. Beams 70 have ends 86 that similarly have pyramid-shaped recesses in them, and these recesses mate with projections 88 mounted on the underside of cross beams 42.

Tubular longitudinal reinforcing beams 40 in the base have exposed, open outer ends at the ends of the base below beams 38. These open ends are spaced so that they will receive the forks of a forklift truck for lifting and maneuvering the basketball assemblies into proper position. The beams 40 also can have side openings 41 (FIG. 3) that permit lifting of the assembly from the side with a forklift truck.

Figure 7:
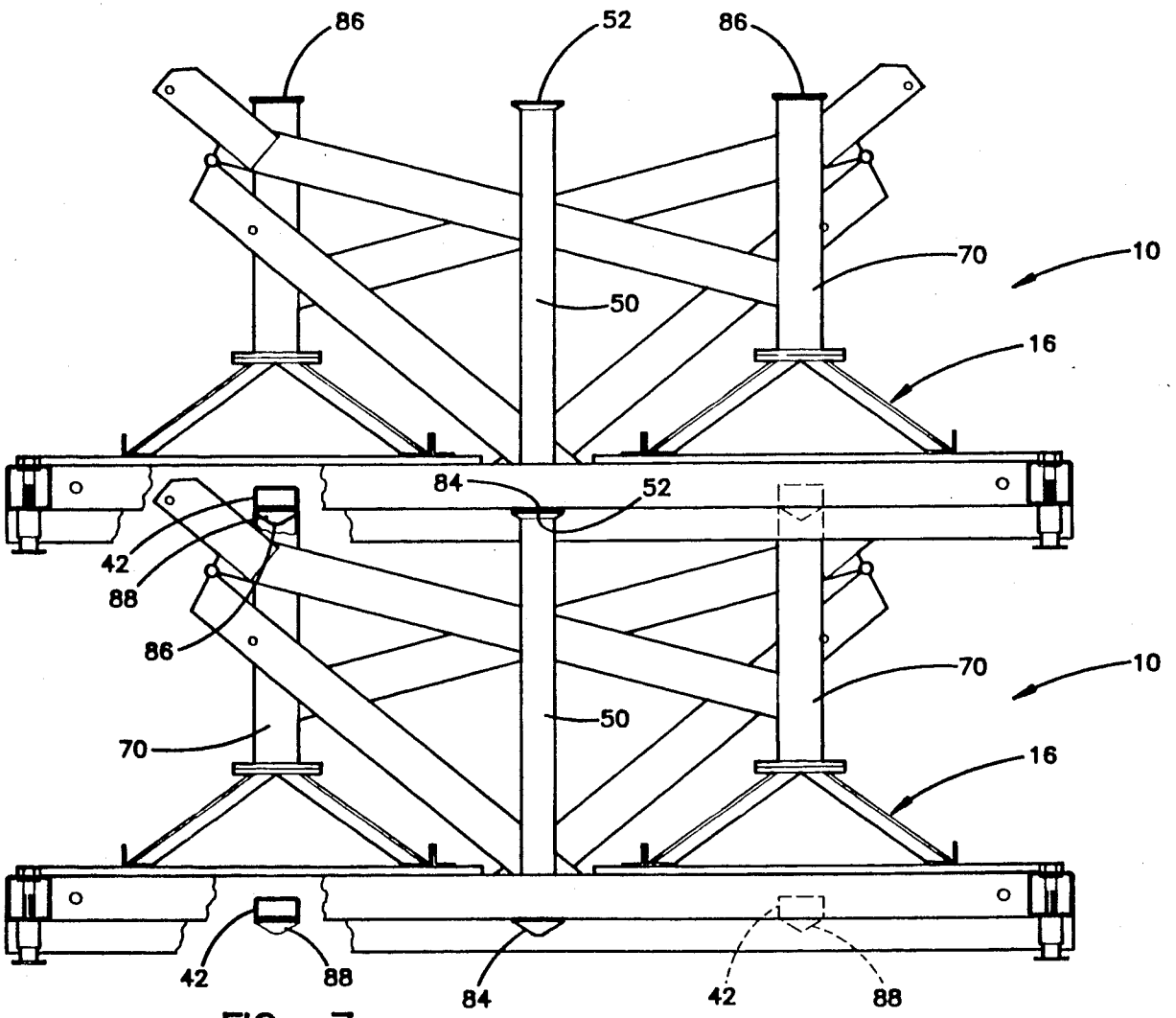
FIG. 7 is a side elevational view showing two goal assemblies stacked on top of each other for transportation and storage.
Figure 8:
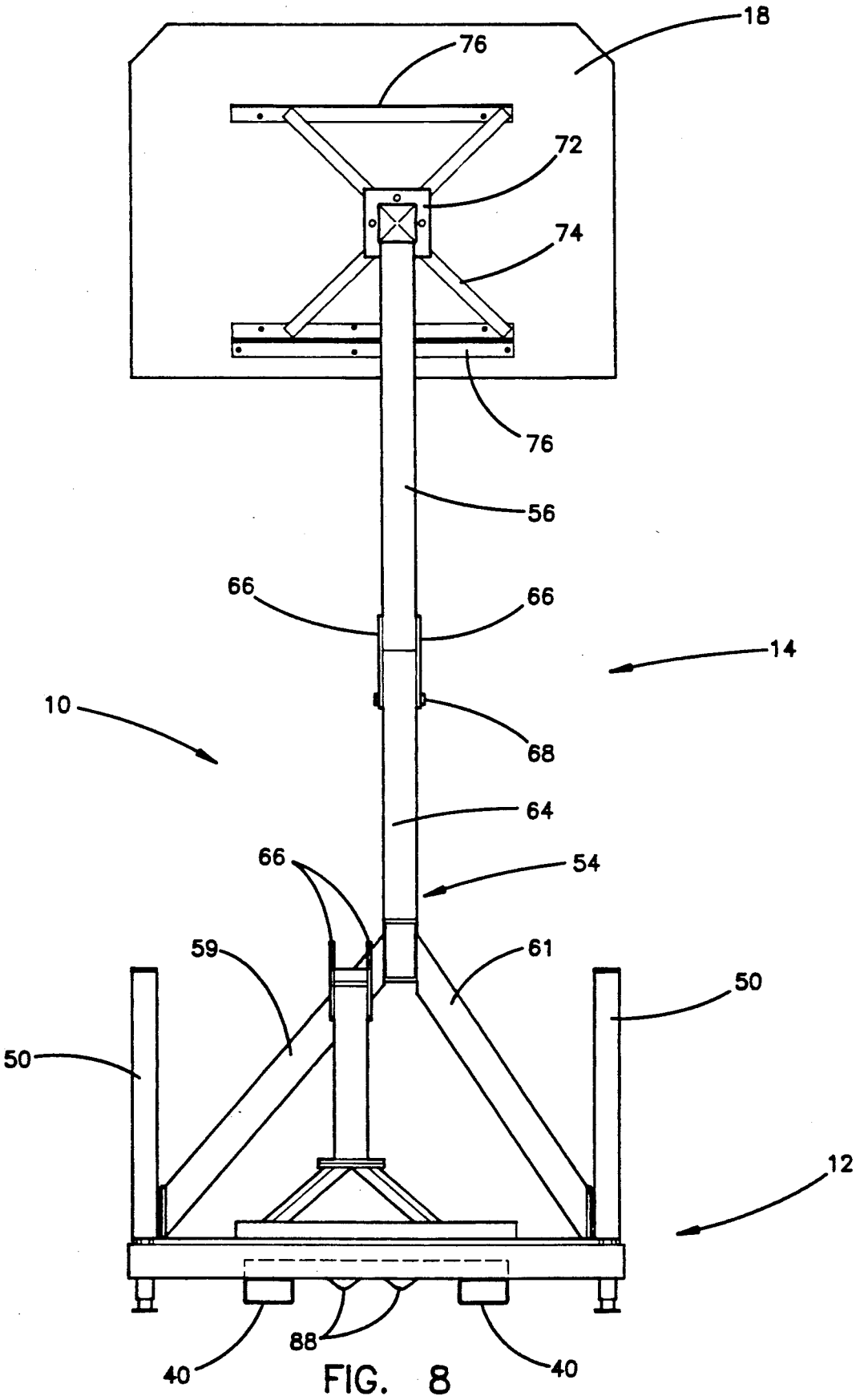
FIG. 8 is an end elevational view of the apparatus shown in FIG. 2.

A pair of stacked goal assemblies 10 are shown in FIG. 7. They are supported by the mating projections and recesses at four separate locations in a polygonal pattern that provides good support against tipping as well as lateral displacement. The plan view of FIG. 5 shows the relative locations of the stacking support columns as well as the manner in which the backboard support mechanisms overlap by virtue of their offset orientation so they may lay side-by-side next to each other when they are lowered into their collapsed positions.

The basketball goal assembly of the present invention provides very sturdy, rigid basketball support mechanisms when the backboard support mechanisms are fully erected and braced with the brace mechanism. It provides a maximum utilization of space by including a pair of basketball baskets positioned back-to-back on the base. At the same time, the entire mechanism is easily collapsible onto a compact base that is easily transportable on conventional flatbed trucks.

As another feature, the base can be fitted with raisable or detachable wheels, so that the goal assembly can be moved on wheels and then lowered to a secure position for use.

It should be understood that the foregoing is merely exemplary of the preferred practice of the present invention and that various changes may be made in the arrangements and details of construction of the embodiments disclosed herein without departing from the spirit and scope of the present invention, which is defined in the appended claims.

I claim:

1. A collapsible and portable basketball goal assembly, wherein collapsible backboard support mechanisms are mounted at opposite ends of a portable base and support a pair of basketball backboards and baskets in back-to-back fashion when erected and fold compactly onto the base for transport when collapsed, the opposite ends of the base being separated by a distance less than the erected height of the baskets, each support mechanism being mounted on the base at a lower end thereof and extending upwardly when erected to support a basketball backboard apparatus at an upper portion thereof, each support mechanism being formed in at least two sections connected together, the support mechanism being foldable inwardly on the base when collapsed, the support mechanism extending more than half way across the base toward the opposite side when collapsed, each support mechanism being formed and positioned on the base such that the two support mechanisms are offset from each other to the extent that they fit downwardly on the base in a side-by-side arrangement when the support mechanisms are collapsed and are maintained generally within the perimeter of the base, thereby facilitating transport of the collapsed assemblies on a truck or the like.

2. A basketball goal assembly according to claim 1, wherein the assembly includes stacking means for stacking a plurality of goal assemblies on top of each other for transport when the support mechanisms are collapsed.

3. A basketball goal assembly according to claim 2, wherein the stacking means comprises a plurality of stacking columns that are spaced apart and supported in an upright position on the base at least when the support mechanisms are collapsed, the support columns having upper ends that engage lower stacking support surfaces on the underside of a basketball goal assembly stacked thereon.

4. A basketball goal assembly according to claim 3, wherein the stacking support columns comprise at least two vertical columns fixed to the base at spaced locations thereon and extending upwardly to upper ends positioned above the level of the support structure when collapsed, the upper surfaces of the support columns being contoured and mating with a corresponding surface on the undersides of a goal assembly mounted thereon so as to urge mating surfaces to nest and resist sideways dislodgement.

5. A basketball goal assembly according to claim 4, wherein the backboard is mounted on a mounting bracket, which is in turn mounted at the upper end of the support mechanism, the support mechanism collapsing in such a way that the backboard is horizontal and lies flat against the base when collapsed, a backboard stacking support column being fixed to the backboard mounting bracket for each backboard and extending perpendicularly away from the back of the backboard, said backboard stacking support columns extending vertically upwardly when the support mechanism is collapsed, the backboard stacking support columns engaging mating surfaces on the underside of a goal assembly stacked thereon.

6. A basketball goal assembly according to claim 1, wherein:

the base comprises a rectangular frame having ends and sides;

each support mechanism comprises:

a lower section pivotally mounted at one end of the frame for inward pivotal movement, the lower section extending inwardly on the base when collapsed and extending upwardly from the end of the frame when erected, the lower section extending more than halfway but not more than all the way across the frame when collapsed; and an upper section pivotally mounted on the lower section for downward and outward pivotal movement with respect to the lower section, the upper section extending part way but not all the way across the frame when collapsed; and the backboard mounting bracket is mounted in a fixed position on the top of the upper section, with a backboard stacking support column extending perpendicularly away from the backboard mounting bracket, the stacking support column and backboard mounting bracket being constructed and connected such that when collapsed the backboard lies horizontally in a face down position with respect to the base and the stacking support member extends perpendicularly upwardly from the backboard to a position to engage and support a collapsed basketball goal assembly placed thereon.

7. A basketball goal assembly according to claim 1, wherein:

the lower section of the support structure includes an A-shaped bottom member having outwardly tapered legs that are pivotally attached to the base at lower ends thereof, with a first beam segment extending upwardly and outwardly from the upper end of the A-shaped member; and the upper section includes a second beam segment that is pivotally connected at a lower end to the upper end of the first beam segment, the backboard mounting bracket being rigidly mounted on an upper end of the second beam segment.

8. A goal assembly according to claim 1, wherein brace means are releasably interconnected between the support mechanisms when erected for reinforcing the support mechanisms.

9. A goal assembly according to claim 8, wherein the brace means comprises a cross strut that is connected between lower sections of the support mechanisms and vertically rising struts that are connected between a central point on the cross strut and upper sections of backboard support mechanisms.

* * * * *